US008366237B2

(12) United States Patent
Phillips et al.

(10) Patent No.: US 8,366,237 B2
(45) Date of Patent: Feb. 5, 2013

(54) PRINT HEAD MAINTENANCE SYSTEM FOR AN INK-JET PRINTER USING PHASE-CHANGE INK PRINTING ON A CONTINUOUS WEB

(75) Inventors: Scott Phillips, West Henrietta, NY (US); Mark Cellura, Webster, NY (US); Elliott Eklund, Penfield, NY (US); Igor Podzorov, Webster, NY (US); Richard Germain, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 398 days.

(21) Appl. No.: 12/409,765

(22) Filed: Mar. 24, 2009

(65) Prior Publication Data

US 2010/0245467 A1 Sep. 30, 2010

(51) Int. Cl.
*B41J 2/165* (2006.01)

(52) U.S. Cl. ..... 347/33; 347/23

(58) Field of Classification Search ..... 347/33, 347/23

See application file for complete search history.

(56) References Cited

U.S. PATENT DOCUMENTS

| | | | | |
|---|---|---|---|---|
| 5,345,863 | A | 9/1994 | Kurata et al. | |
| 5,389,958 | A | 2/1995 | Bui et al. | |
| 5,406,315 | A | 4/1995 | Allen et al. | |
| 5,777,650 | A | 7/1998 | Blank | |
| 5,796,398 | A | 8/1998 | Zimmer | |
| 6,113,231 | A | 9/2000 | Burr et al. | |
| 6,361,230 | B1 | 3/2002 | Crystal et al. | |
| 6,485,140 | B1 | 11/2002 | Lidke et al. | |
| 6,494,570 | B1 | 12/2002 | Snyder | |
| 7,413,361 | B2 * | 8/2008 | Kawaguchi | 400/636 |
| 2004/0012651 | A1 | 1/2004 | Agarwal et al. | |
| 2006/0044344 | A1 * | 3/2006 | Umeda | 347/33 |
| 2006/0227162 | A1 | 10/2006 | Phillips et al. | |
| 2008/0024550 | A1 * | 1/2008 | Miyazawa | 347/33 |
| 2009/0051728 | A1 * | 2/2009 | Miyazawa | 347/30 |

FOREIGN PATENT DOCUMENTS

| | | |
|---|---|---|
| EP | 0988977 | 3/2000 |
| EP | 1445104 | 8/2004 |

OTHER PUBLICATIONS

European Search Report corresponding to European Patent Application 10156821.0, European Patent Office, Rijswijk, Netherlands, Jul. 30, 2010 (8 pages).

* cited by examiner

*Primary Examiner* — Jason Uhlenhake

(74) *Attorney, Agent, or Firm* — Maginot, Moore & Beck, LLP

(57) ABSTRACT

A maintenance assembly for cleaning a plurality of printheads in a printing machine comprises two or more cleaning members, each of the cleaning members sized and positioned to clean at least one but less than all of the plurality of printheads when in a cleaning position. A drive mechanism associated with each of the two or more cleaning members is configured to selectively move an associated cleaning member to and from the cleaning position and a retracted position. The cleaning members are supported on a frame with a mechanism provided for translating the frame into position juxtaposed with the plurality of printheads and a further mechanism to swipe the cleaning members across the printheads. The maintenance assembly is operable to clean only selected printheads in a single operation.

17 Claims, 6 Drawing Sheets

PRINT HEAD MAINTENANCE SYSTEM FOR AN INK-JET PRINTER USING PHASE-CHANGE INK PRINTING ON A CONTINUOUS WEB

TECHNICAL FIELD

The present disclosure relates to ink-jet printing, particularly involving phase-change inks printing on a substantially continuous web.

BACKGROUND

Ink jet printing involves ejecting ink droplets from orifices in a print head onto a receiving surface to form an image. The image is made up of a grid-like pattern of potential drop locations, commonly referred to as pixels. The resolution of the image is expressed by the number of ink drops or dots per inch (dpi), with common resolutions being 300 dpi and 600 dpi.

Ink-jet printing systems commonly utilize either a direct printing or offset printing architecture. In a typical direct printing system, ink is ejected from jets in the print head directly onto the final receiving web. In an offset printing system, the image is formed on an intermediate transfer surface and subsequently transferred to the final receiving web. The intermediate transfer surface may take the form of a liquid layer that is applied to a support surface, such as a drum. The print head jets the ink onto the intermediate transfer surface to form an ink image thereon. Once the ink image has been fully deposited, the final receiving web is then brought into contact with the intermediate transfer surface and the ink image is transferred to the final receiving web.

U.S. Pat. No. 5,389,958, assigned to the assignee of the present application, is an example of an indirect or offset printing architecture that utilizes phase change ink. The ink is applied to an intermediate transfer surface in molten form, having been melted from its solid form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving web, such as a sheet of media, is then fed into the transfer nip and the ink image is transferred to the final receiving web.

U.S. Pat. Nos. 5,777,650; 6,494,570; and 6,113,231 show the application of pressure to ink-jet-printed images. U.S. Pat. Nos. 5,345,863; 5,406,315; 5,793,398; 6,361,230; and 6,485,140 describe continuous-web ink-jet printing systems.

SUMMARY

According to one aspect, a maintenance assembly for cleaning a plurality of printheads in a printing machine comprises two or more cleaning members, each of the cleaning members sized and positioned to clean at least one but less than all of the plurality of printheads when in a cleaning position. A drive mechanism associated with each of the two or more cleaning members is configured to selectively move an associated cleaning member to and from the cleaning position and a retracted position. The maintenance assembly may include a frame supporting the cleaning members, a mechanism for translating the frame into position juxtaposed with the printheads, and a further mechanism for translating the cleaning members across the printheads.

According to another aspect, a printing machine comprises a plurality of printheads having a front face for applying ink to a substrate, and at least two cleaning members, each of the cleaning members sized and positioned to clean the front face of at least one but less than all of the plurality of printheads when in a cleaning position. A drive mechanism associated with each of the cleaning members is configured to selectively move the associated cleaning member to and from the cleaning position and a retracted position. The plurality of printheads may be provided in a plurality of rows with a corresponding plurality of rows of cleaning members. A swiping mechanism is provided to draw each row of cleaning members across a corresponding row of printheads.

In a further aspect, a method for cleaning a plurality of printheads in a printing machine comprises moving a frame supporting two or more cleaning members relative to the plurality of printheads. The cleaning members are sized and positioned to clean at least one but less than all of the plurality of printheads. The method further comprises selectively moving one or more of the two or more cleaning members to the cleaning position prior to or during movement of the frame. In this manner all or less than all of the plurality of printheads can be selectively cleaned in a single cleaning stroke.

DETAILED DESCRIPTION

Figure 1:
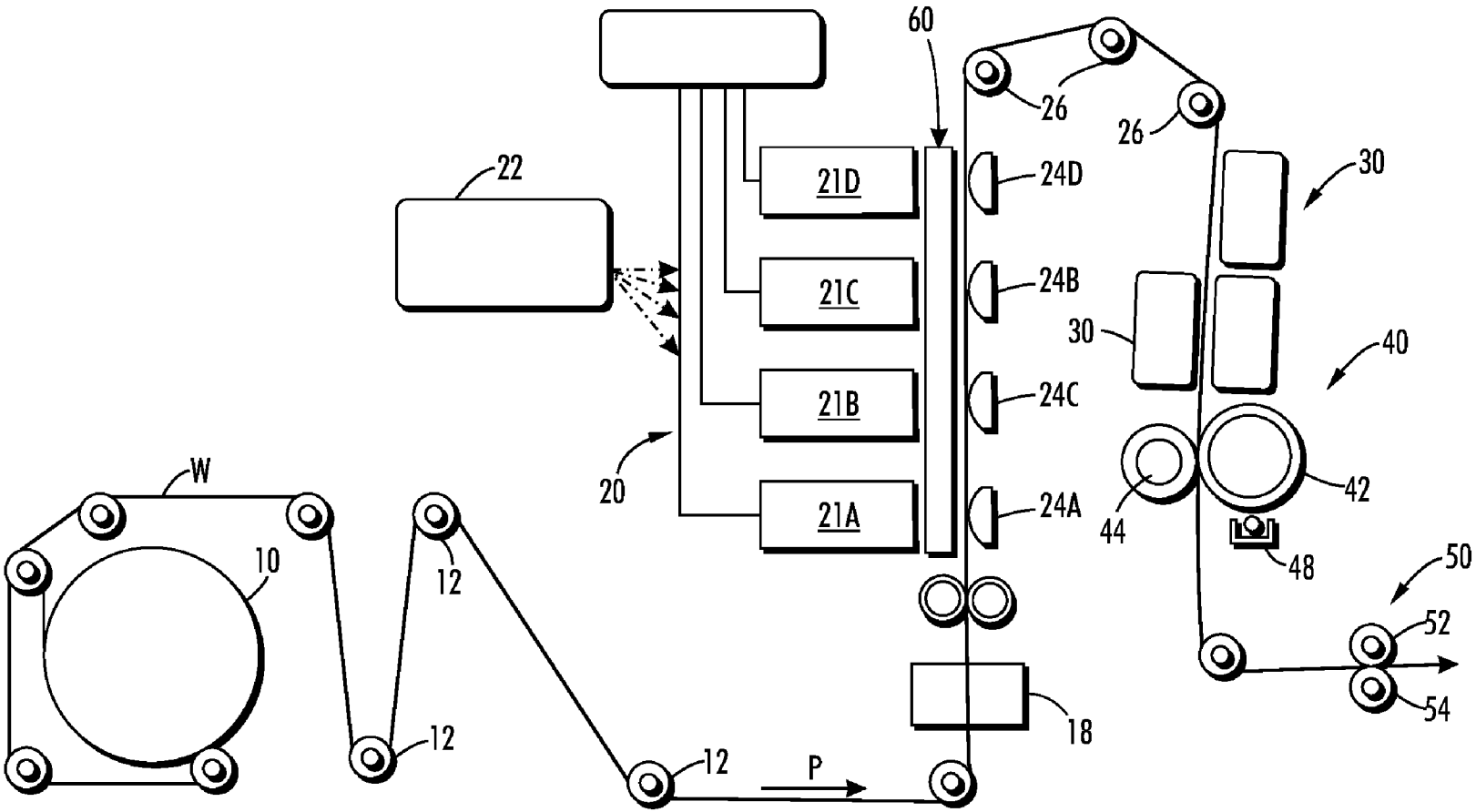
FIG. 1 is a simplified elevational view of a direct-to-sheet, continuous-web, phase-change ink printer.

FIG. 1 shows a simplified elevational view of a direct-to-sheet, continuous-web, phase-change ink printer. A long (i.e., substantially continuous) web W of "substrate" (paper, plastic, or other printable material), supplied on a spool 10, is unwound as needed, propelled by a variety of motors, not shown. A set of rolls 12 controls the tension of the unwinding web as the web moves through a path.

Along the path there is provided a preheater 18, which brings the web to an initial predetermined temperature. The web W then moves through a printing station 20 which in one particular system includes several rows 21A, 21B, 21C, and 21D of printheads, each row effectively extending across the width of the web and being able to place ink of various colors directly (i.e., without use of an intermediate or offset member) onto the moving web. In some systems, each row includes a single printhead that is sized to extend across substantially the entire width of the web.

As is generally familiar, each of the four primary-color images placed on overlapping areas on the web W combine to form a full-color image, based on the image data sent to each printhead through image path 22. In various possible embodiments, there may be provided multiple printheads for each primary color; the printheads can each be formed into a single linear array; the function of each color printhead can be divided among multiple distinct printheads located at different locations along the process direction P; or the printheads or portions thereof can be mounted movably in a direction transverse to the process direction P, such as for spot-color applications.

The ink directed to web W in this embodiment is a "phase-change ink," by which is meant that the ink is substantially solid at room temperature and substantially liquid when initially jetted onto the web W. Common phase-change inks are typically heated to about 100° C. to 140° C., and thus in liquid phase, upon being jetted onto the web W. Generally speaking, the liquid ink cools down quickly upon hitting the web W.

Associated with each primary color printhead is a backing member 24A, 24B, 24C, 24D, typically in the form of a bar or roll, which is arranged substantially opposite the printhead on the other side of web W. Each backing member is used to position the web W so that the gap between the printhead and the sheet stays at a known, constant distance. Each backing member can be controlled to cause the adjacent portion of the web to reach a predetermined "ink-receiving" temperature, in one practical embodiment, of about 40° C. to about 60° C.

Following the printing zone 20 along the web path is a series of tension rolls 26, followed by one or more "midheaters" 30. The midheater 30 can use contact, radiant, conductive, and/or convective heat to bring the web W to a target temperature suitable for desired properties when the ink on the web is sent through the spreader 40. In one embodiment, a useful range for a target temperature for the midheater is about 35° C. to about 80° C. Following the midheaters 30, along the path of web W, is a "spreader" 40, that applies a predetermined pressure, and in some implementations, heat, to the web W. The function of the spreader 40 is to take what are essentially isolated droplets of ink on web W and smear them out to make a continuous layer by pressure, and, in one embodiment, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rolls, such as image-side roll 42 and pressure roll 44, which apply heat and pressure to the web W.

The spreader 40 can also include a cleaning/oiling station 48 associated with image-side roll 42, suitable for cleaning and/or applying a layer of some lubricant or other material to the roll surface. Such a station coats the surface of the spreader roll with a lubricant such as amino silicone oil having viscosity of about 10-200 centipoises. Only small amounts of oil are required and the oil carry out by web W is only about 1-10 mg per A4 size page.

Following the spreader 40, the printer in this embodiment includes a "glosser" 50, whose function is to change the gloss of the image (such a glosser can be considered an "option" in a practical implementation). The glosser 50 applies a predetermined combination of temperature and pressure, to obtain a desired amount of gloss on the ink that has just been spread by spreader 40. Additionally, the glosser roll surface may have a texture that the user desires to impress on the ink surface. The glosser 50 includes two rolls (image-side roll 52 and pressure roll 54) forming a nip through which the web W passes. In one practical embodiment, the controlled temperature at spreader 40 is about 35° C. to about 80° C. and the controlled temperature at glosser 50 is about 30° C. to about 70° C.

Figure 2:
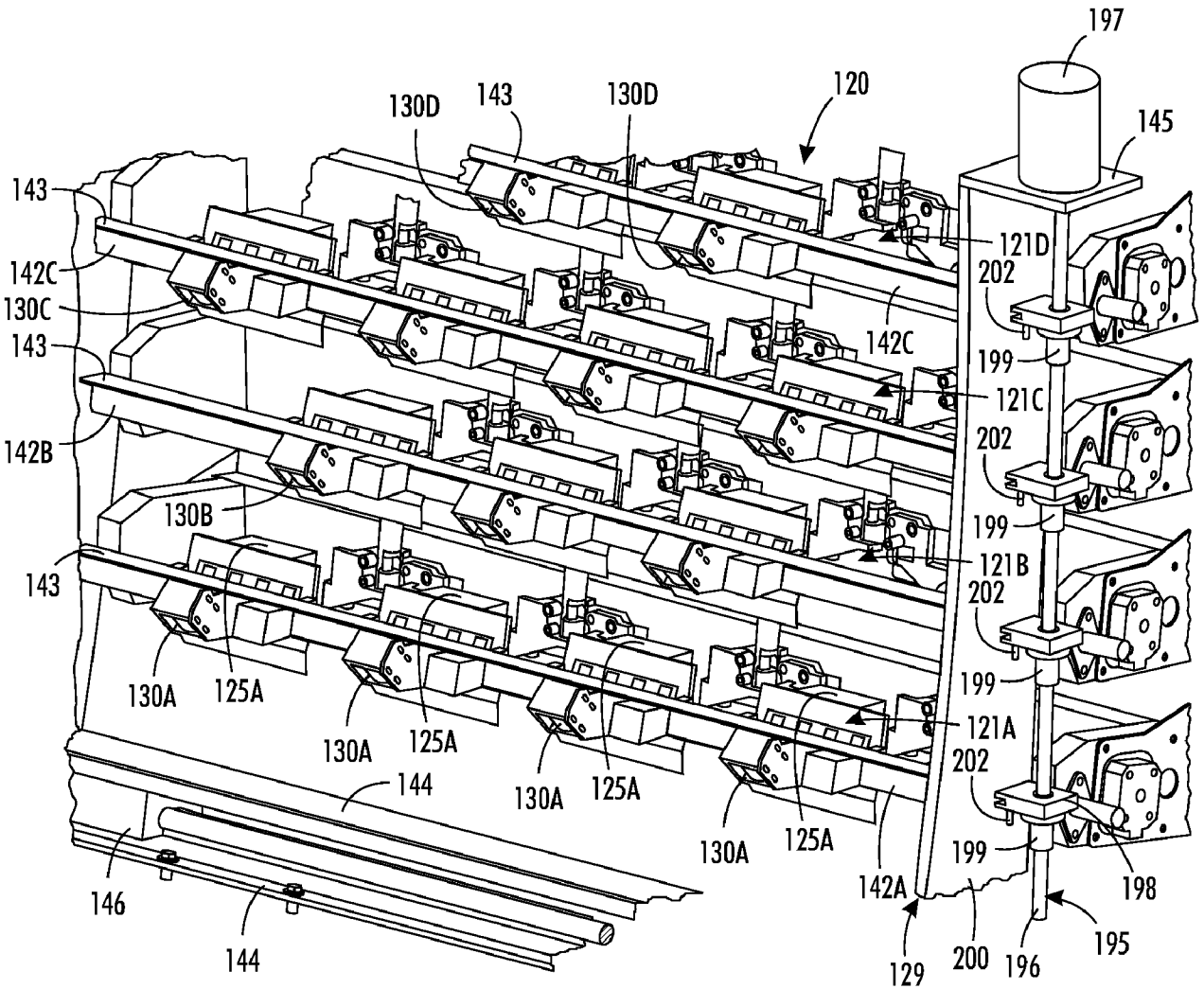
FIG. 2 is a front perspective view of a maintenance assembly according to one embodiment in its operating position over a printing station.

In the system shown in FIG. 1, each row 21A-21D includes a single printhead sized to span the width of the web W. In other systems, each row includes a plurality of printheads spaced across the width of the web. In these systems, the printheads in successive rows may be staggered relative to each other so that the combination of the printheads in successive rows provides full coverage of substantially the entire width of the web. Thus, as depicted in FIG. 2, a first row 121A includes four printheads 125A, while the adjacent row 121B includes three printheads 125B. It can be seen that the four printheads 125A are staggered in the first row 121A while the three printheads 125B in the second row 1221B are staggered to occupy or overlap the gap between the printheads of the first row. With this arrangement, the combination of the printheads in the two rows 121A and 121B provide complete coverage of the printable width of the web W.

It can be appreciated that in a multi-color printing machine this pattern of staggered printheads in adjacent rows (i.e., rows 121A and 121B) can be repeated for each color of ink to be applied. Thus, for a four-color system four pairs of printhead rows may be provided, for a total of eight rows of printheads. Thus, in a four-color printing system, the eight rows of printheads will total 28 individual printheads, like the printheads 125A, 125B (i.e., four rows of four and four rows of three printheads) In a six color system, 12 rows of printheads would be provided totaling 42 individual printheads.

In some continuous web printing systems, a maintenance unit 60 (FIG. 1) is provided that is operable to clean the printheads. During use the printheads gradually accumulate residual ink and contaminants that can compromise the function of the printhead. The maintenance unit 60 is thus configured to periodically engage the printheads to perform a cleaning operation. The maintenance unit may be moved between the printhead rows 21A-21D and the corresponding backing members 24A-24D or between the printheads and the continuous web W. In certain embodiments, this action may be accomplished by retracting the web and backing members away from the printhead rows and conveying the maintenance unit 60 into the gap. Alternatively, the printhead rows may be retracted to provide access for the maintenance unit.

One type of maintenance unit is shown in published application US2006/0227162 (the '162 application), assigned to the assignee of the present application, the disclosure of which is incorporated herein by reference. In the system disclosed in the '162 application the printheads are retracted to allow passage of a maintenance assembly that is conveyed along a track. The maintenance assembly includes a single wiper formed of a rigid but flexible material capable of generating a wiping force across the face of the printheads. A cleaning cycle may be performed periodically in which all printheads are cleaned by the wiper of the maintenance unit, and/or may be performed when indications arise of reduced performance of one or more printheads.

While the single wiper approach disclosed in the '162 application is well suited for printing systems with few printheads (such as the four printheads disclosed in the application), this approach presents certain problems in systems having a large number of printheads, such as the system shown in FIG. 2. While wiping a compromised printhead is necessary, cleaning a properly working printhead that has not accumulated any debris or residual ink can induce performance problems, such as jetting failures. It is therefore desirable to perform a cleaning operation on a printhead only when necessary. In large architecture systems, such as shown in FIG. 2, it can be easily envisioned that only a small percentage of printheads may require maintenance at any given time. It can also be envisioned that of the 84 printheads in the illustrated embodiment, at least one printhead may require maintenance during any given printing cycle of the system. It can thus be understood that for large architecture systems, a single wiper maintenance unit will perform a great many unnecessary cleaning operations on printheads that are otherwise working properly.

There is a need for a maintenance or cleaning system that is suitable for large architecture printing systems that employ a large number of individual printheads. It is further desirable that such a maintenance system be capable of high quality motion in a rapid cleaning cycle.

According to embodiments disclosed herein, a maintenance assembly 129 is provided that can be positioned over a printing station 120 having an array or matrix of printhead 125A-D arranged in a plurality of rows 121A-D. The maintenance assembly 129 thus includes a like number of rows of cleaning mechanisms 130A-D, each aligned with a corresponding row 121A-D of printheads and oriented in opposition to a corresponding printhead 125A-D on the row. In one embodiment, the rows of cleaning mechanisms are supported on a frame 140 and particularly on corresponding mounting beams 142A-D. Cross beams 143 may be provided to add rigidity to the frame. The base plate 144 may be connected to a drive mechanism 146 that is operable to extend and retract the maintenance assembly 129 to and from registry with the printing station 120. The drive mechanism and frame 140 is configured to allow the maintenance assembly to be retracted entirely clear of the printing station to allow the backing members 24A-D (FIG. 1) to return to registration with the printhead rows 121A-D to resume printing operation of the machine.

Figure 3:
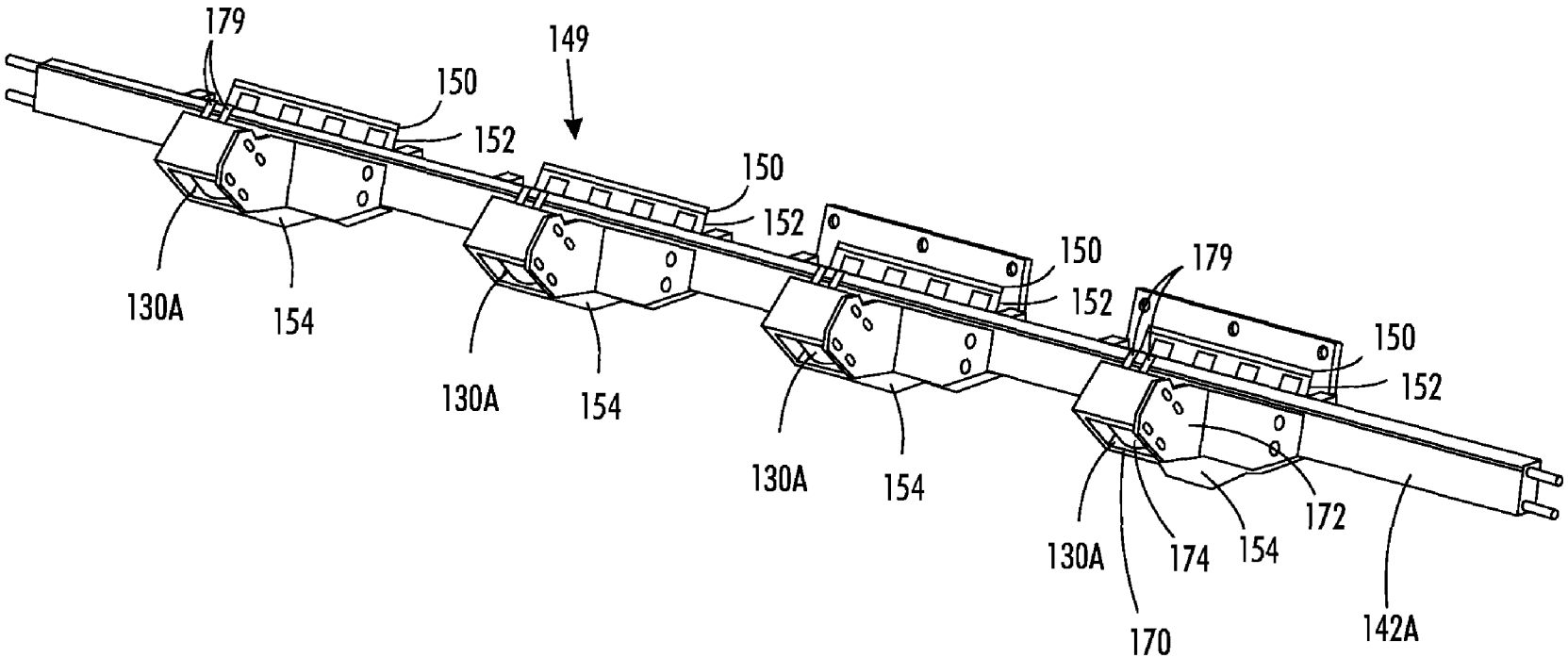
FIG. 3 is an enlarged perspective view of one row of cleaning mechanisms from the maintenance assembly shown in FIG. 2.
Figure 4:
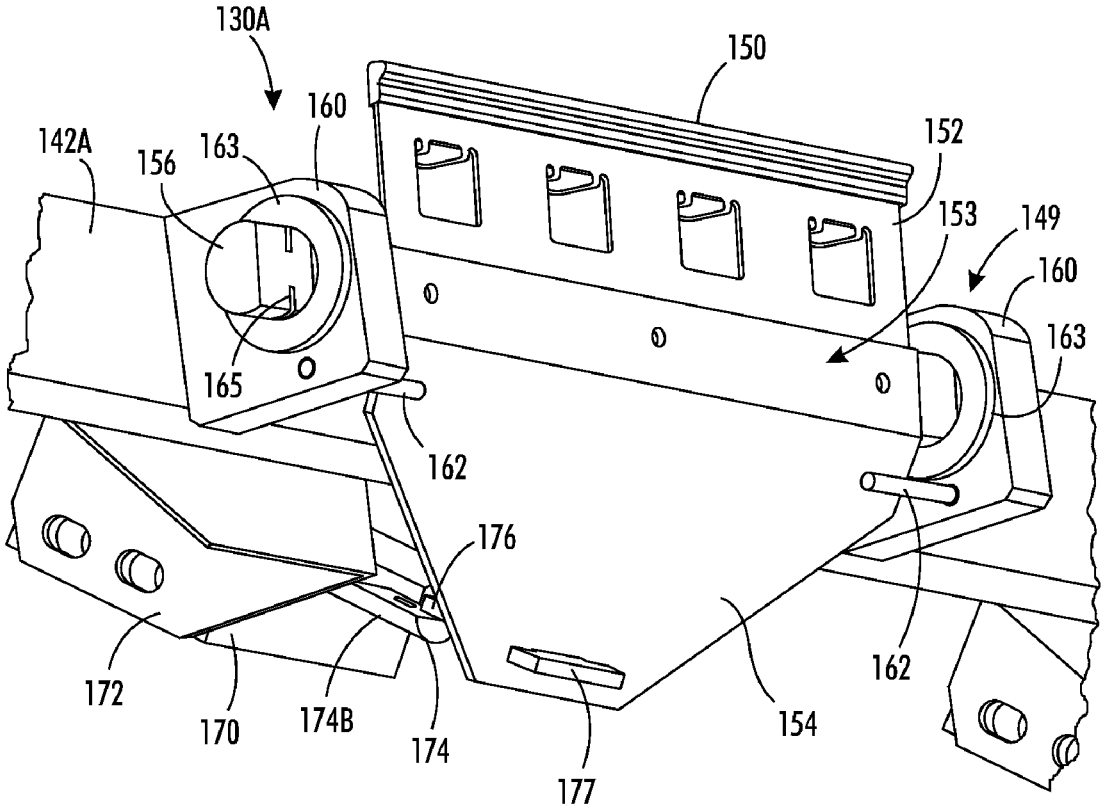
FIG. 4 is an enlarged perspective view of a wiper blade mechanism of a cleaning mechanism according to one embodiment.

As shown in more detail in FIGS. 3-4, each cleaning mechanism 130A-D includes two components mounted to a corresponding mounting beam 142A. One component is the wiper mechanism 149 that is operable to contact and clean the printing face 126 of a corresponding printhead 125A. The wiper mechanism 149 includes a wiper blade 150 mounted on the free end of a wiper arm 152. The wiper blade 150 may be configured and formed in a manner suitable to effectively remove residual ink and debris from the print face 126 of a printhead. Thus, in a specific embodiment, the wiper blade 150 has a length sufficient to span the entire width of the print face 126 and in some cases slightly beyond the sides of the print face. The blade is formed of a resilient material, such as a urethane, that can conform to the print face under slight pressure, that can withstand the temperatures in a typical printing machine, and that is impervious to the residual ink composition. In certain embodiments, the blade 150 may be configured to be removably mounted on the end of the wiper arm 152, or may be permanently affixed to the arm, such as by adhering. In other embodiments, the wiper blade may be integrally formed with the wiper arm.

The wiper arm 152 is preferably part of a unitary plate that defines the arm, a mounting plate 153 and a pivot arm 154, as shown in FIG. 4. The mounting plate 153 is fastened to a pivot axle 156 that is itself rotatably supported at each end by mounting blocks 160. The mounting blocks are fastened to the corresponding mounting beam 142A and may include bearing assemblies 163 that support the axle 156 for rotation. The axle may be held in position by snap rings (not shown) mounted in snap ring grooves 165 at each end of the axle. It can be appreciated that the axle 156 allows the wiper arm 152 to pivot so that the wiper blade 150 may move toward and away from the print face 126. A pair of stops 162 may be provided on the mounting blocks 160 to restrict rotation of the pivot arm 154 beyond a predetermined point.

The wiper arm 152 is pivoted by the second component of the wiper mechanism 149—the drive mechanism 174. The drive mechanism may be supported within a housing 170 that is attached to a corresponding mounting beam 142A by at least one mounting plate 172, as best seen in FIG. 3. The drive mechanism is engaged to the pivot arm 154 by a link arm 176 connected at an attachment element 177. In one embodiment, the pivot arm 154 defines a slot which receives the link arm 176, while the attachment element 177 is in the form of a T-shaped end of the link arm, as shown in FIG. 4.

Figure 5:
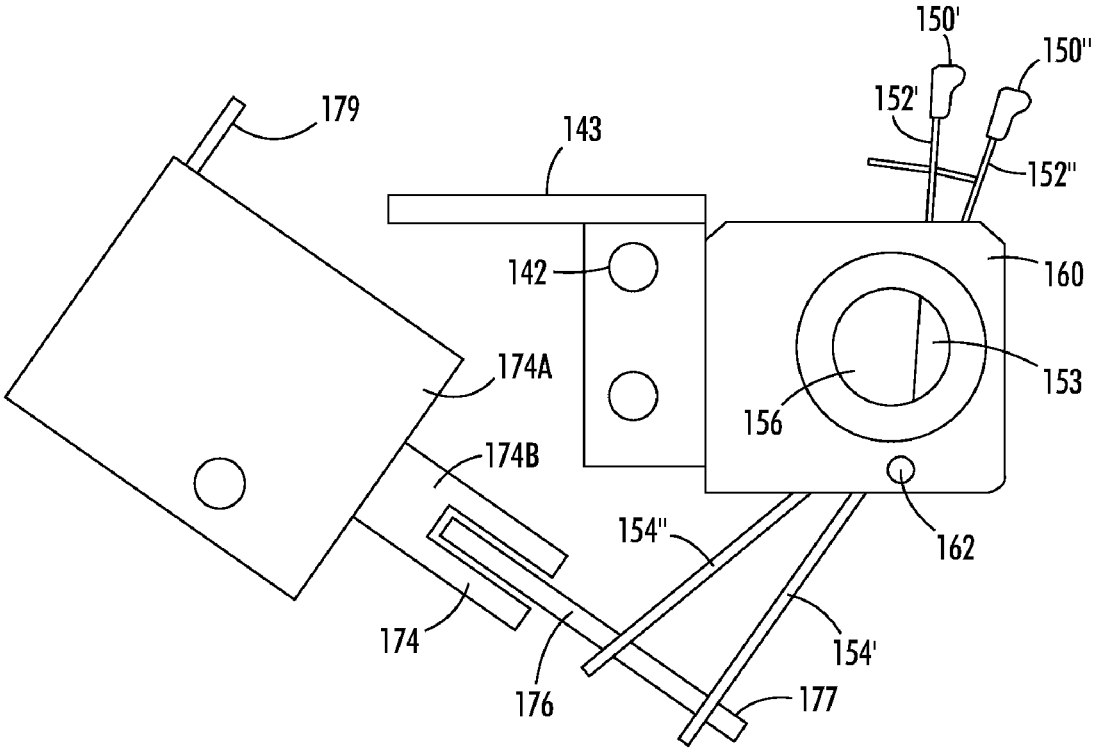
FIG. 5 is an enlarged side view of the wiper blade mechanism shown in FIG. 4.

In one embodiment, the drive mechanism 174 includes a solenoid 174*a* with an armature 174*b* that is connected to the link arm 176, as shown in FIG. 5. In one state, the armature 174*b* of the solenoid 174*a* is extended to thereby push the pivot arm 154 away from the drive mechanism to position 154'. This movement pivots the wiper arm 152 about the axle 156 to the position 152' to move the wiper blade 150 away from the printing face 126 of the associated printhead to position 150'. In another state, the armature is retracted within solenoid, which pulls the pivot arm toward the drive mechanism to position 154". This movement pivots the wiper arm in the opposite direction to move the wiper arm to position 152" which thereby moves the wiper blade toward the printing face 126 to position 150". In this position 150", the wiper mechanism is in a cleaning position capable of cleaning the printing face.

In the illustrated embodiment, the solenoid 174*a* may be electric with contacts 179 provided for electrical connection to a power source and a control device. A variety of solenoids may be used that are capable of maintaining the two states 150' and 150" described above. The solenoid must be capable of holding the wiper mechanism in the cleaning position 150" with the wiper blade firmly contacting the printing face. The solenoid 174*a* is preferably configured so that the armature 174*b* is extended when the solenoid is de-energized. The solenoid may be spring-biased to the extended position with the solenoid working against the biasing force when actuated. In an alternative version, the wiper mechanism 149 itself may be biased to one position or the other with the drive mechanism 174 configured to work against the biasing force. It is preferable that the wiper blade 150 be biased to the non-cleaning position 150' to avoid damage to maintenance assembly or the printing station as the maintenance assembly is moved to and from its operating position.

Figure 6:
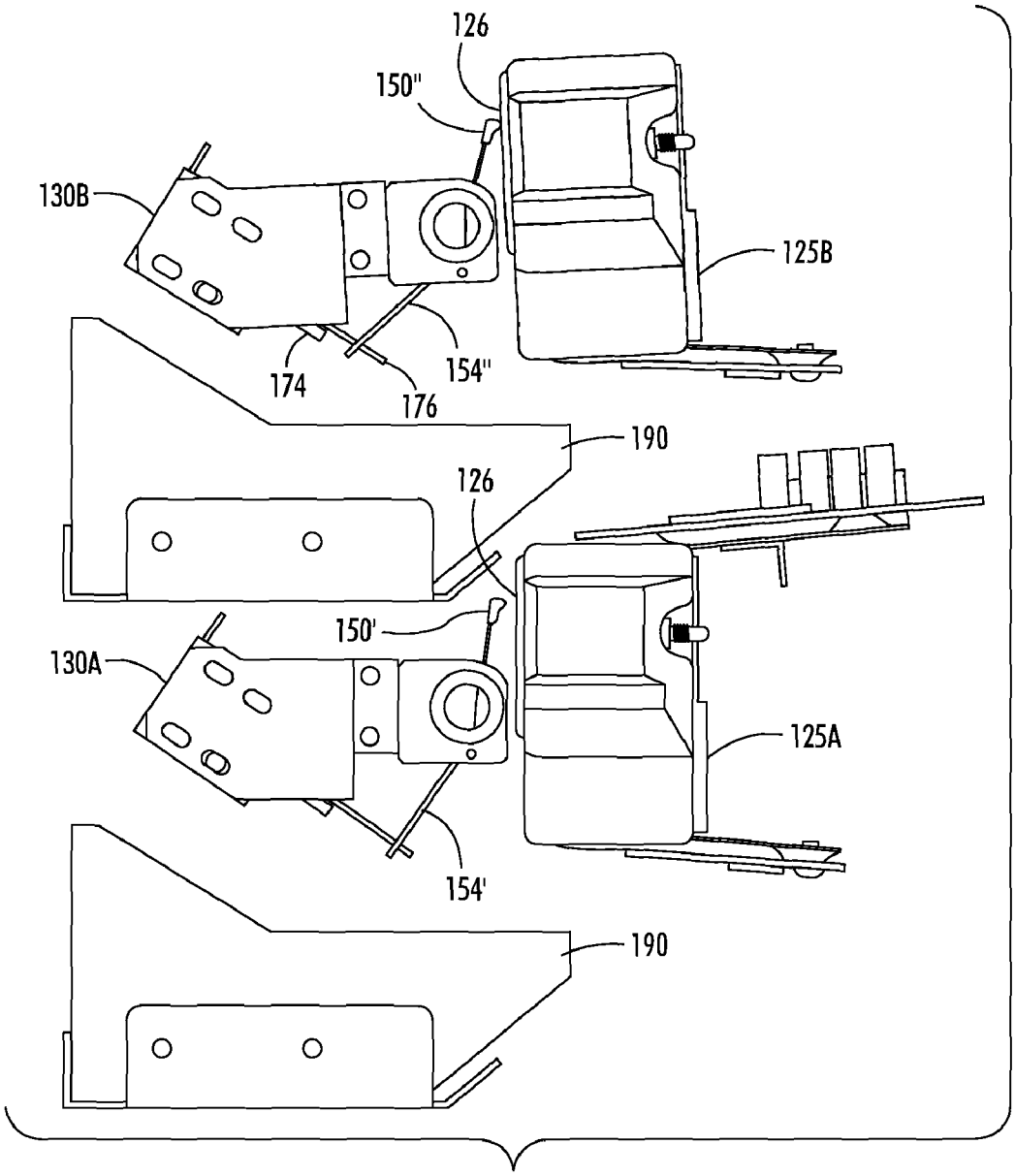
FIG. 6 is a side cut-away view of two rows of cleaning mechanisms and printheads of the system depicted in FIG. 2.

As illustrated in FIG. 6, the maintenance assembly 129 disclosed herein can be configured so that the wiper blades may be in retracted or cleaning positions depending upon the printhead. Thus, the cleaning mechanism 130A is shown with the wiper blade in the retracted position 150' away from the face 126 of the printhead 125A. The cleaning mechanism 130B, on the other hand, is energized so that the wiper blade is in the position 150" in contact with the printing face 126 of printhead 125B. The state of the cleaning mechanisms is determined by control signals provided to the corresponding drive mechanisms 174, which can be determined by a master controller linked to each drive mechanism.

It can be noted in FIG. 6 that the maintenance assembly may include a collection tray 190 oriented between vertically adjacent rows of printing stations. The collection trays are arranged beneath each printing face 126 to collect liquid and debris removed from the face by the wiper blade 150. The collection trays may be removable for cleaning or may be arranged for gravity flow to a common collection reservoir.

As explained above, the rows of cleaning mechanisms 130A-D of the maintenance assembly 129 are supported on a frame 140 and particularly on corresponding mounting beams 142A-D. The frame 140 is configured to be retracted entirely clear of the printing station to allow the backing members 24A-D (FIG. 1) to return to registration with the printhead rows 121A-D to resume printing operation of the machine. The frame 140 also includes means for driving the cleaning mechanisms vertically across the printing faces. Thus, in one embodiment, a sweep mechanism 195 is provided that simultaneously moves each row of cleaning mechanisms vertically. The sweep mechanism may include a vertical rod 196 attached to each mounting beam 142A-D by a corresponding drive block 198. The vertical rod is driven up or down by a drive member 197, which may be a solenoid or other suitable device. The activation and operation of the drive member 197 is governed by the master controller to coordinate the activation of the drive member with the activation of the drive assemblies 146 for the involved cleaning mechanisms.

In one embodiment, the rod 196 is a lead screw and the drive member 197 is a stepper motor mounted to the top plate 145 of the frame 140. Each drive block 198 may include a corresponding nut 199 that threadedly engages the lead screw 196 so that the nut translates up and down as the lead screw is rotated by the motor 197. The drive block 198 further includes a pin (not shown) that extends through a pin slot 202 formed in a side panel 200 of the frame 140. Each pin is attached to a corresponding mounting beam 142A-D so that the beam, and therefore the rows of cleaning mechanisms 130A-D, moves with the corresponding drive block.

In one embodiment, the sweep mechanism 195 includes a vertical rod and drive block arrangement at the opposite side of the frame 140. The drive member, or stepper motor, 197 at each side is synchronized to keep the mounting beams 142A-D from skewing and to help maintain a uniform pressure and rate of movement during any given cleaning sweep. The stepper motors allow for finely calibrated movement of the cleaning mechanisms 130A-D across the corresponding printing face 126 based on step counts from a predetermined home position. The stepper motors also allow calibration of that home position at each side of the frame.

In operation, the master controller receives a signal to initiate a maintenance operation on the printhead array. That signal may be based on information from sensors associated with the printheads 125, on an operator initiated command, on an associated operating command for the printing machine (such as initial start-up of the machine), or on the occurrence of pre-programmed events (such as a predetermined number of printing operations). When a maintenance operation is signaled, the master controller directs the motor 146 to extend the maintenance assembly 129 into registry with the printing station 120 so that each wiper mechanism 149 is aligned with a corresponding printhead 125.

In one initial step, the sweep mechanism 195 may be activated to position each wiper blade at the lower end of the printhead face 126 and each blade to the wiping position 150" (FIG. 5) to dab the lower end of the face to remove any cold ink that may have been left on the wiper blade after the prior cleaning cycle. The wiper blades may then be retracted and the sweep mechanism 195 actuated to position the cleaning mechanisms 130A-D at the upper end of the printhead face. The wipers needed for maintenance are then activated into the extended position 150", while the wipers for the printheads that do not require cleaning remain in the retracted position 150'. The sweep mechanism is then activated to drive the cleaning mechanisms downward, thereby sweeping the activated wiper blades across the desired printhead faces. The residue is driven to the collection trays 190 beneath each cleaning mechanism. The energized wiper blades are retracted and the maintenance assembly 129 is withdrawn so the printing machine can resume normal operation.

It can be appreciated that the maintenance assembly 129 disclosed herein provides a great deal of flexibility to the cleaning operation. Individual wiper mechanisms can be activated by a master controller in response to indications for individual printing stations. Thus, sensors at each printing station may indicate the need for cleaning or a maintenance schedule for each printing station stored and accessed by the central controller at the beginning of a maintenance cycle. The use of a wiper mechanism dedicated to each printing station avoids color mixing for multiple-color printing systems. The maintenance assembly also reduces the time required for printhead maintenance since all printheads are serviced simultaneously in a single pass.

It will be appreciated that the maintenance assembly can be used with a variety of printing machines. "Printing machines" as used herein may encompass any apparatus, such as a copier, bookmaking machine, multi-function machine, printer, etc., which performs a print outputting function. The term "printhead" as used herein can encompass a variety of devices for applying a printing media to a substrate, such as the solid ink or phase-change ink devices disclosed herein.

As described herein, the cleaning members or wiper mechanism includes a blade formed of a rigid yet flexible material that is suited for wiping solid ink residue from a printhead. It is contemplated that the maintenance assembly disclosed herein may incorporate other cleaning members based on the nature of the printhead and the printing media. For instance, the wiper blade may be replaced by a foam element, a brush or other components capable of removing residue, debris and contaminants from a printing surface.

It will be appreciated that various of the above disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A maintenance assembly for cleaning a plurality of printheads in a printing machine, comprising:

a plurality of cleaning members supported on a plurality of beams within a frame, each of said cleaning members having a length that spans a width of a single printhead and is configured to be positioned opposite one printhead in the plurality of printheads in a one-to-one correspondence between the printheads in the plurality of printheads and the cleaning members in the plurality of cleaning members;

a plurality of drive mechanisms, each drive mechanism being associated with one of said cleaning members in a one-to-one correspondence between the drive mechanisms in the plurality of drive mechanisms and the cleaning members in the plurality of cleaning members, each drive mechanism configured to selectively move the associated cleaning member between a cleaning position, in which the cleaning member contacts a face of the printhead opposite the cleaning member and spans across the width of the single printhead contacting the cleaning member, and a retracted position, in which the cleaning member does not contact the face of the printhead opposite the cleaning member;

a sweep mechanism operatively connected to the beams to move the beams in a vertical direction with reference to the plurality of printheads to move each cleaning member contacting the face of the printhead opposite the cleaning member from an upper end of the printhead face to a lower end of the printhead face; and a mechanism operatively connected to the frame to translate said frame relative to the plurality of printheads to retract the plurality of cleaning members from a position where the cleaning members are in one-to-one correspondence with the plurality of printheads to enable at least one backing member to return to a position opposite the plurality of printheads.

2. The maintenance assembly according to claim 1, wherein each cleaning member in said plurality of cleaning members includes a single wiper blade.

3. The maintenance assembly according to claim 2, wherein each wiper blade is formed of a rigid but flexible material.

4. The maintenance assembly according to claim 1, wherein:

each drive mechanism in the plurality of drive mechanisms being configured to pivot a wiper blade of the cleaning member associated with the drive mechanism.

5. The maintenance assembly according to claim 4, wherein each drive mechanism in the plurality of drive mechanisms includes a solenoid.

6. The maintenance assembly according to claim 4, wherein:

each cleaning member in the plurality of cleaning members includes a pivot arm that pivots about a pivot axle;

each wiper blade of each cleaning member is mounted to one end of the pivot arm of the cleaning member; and each drive mechanism of each cleaning member is connected to the pivot arm of the cleaning member associated with the drive mechanism to pivot said pivot arm and move the wiper blade to and from said cleaning position and said retracted position.

7. The maintenance assembly according to claim 1 further comprising:

a control component operable to selectively activate each drive mechanism in the plurality of drive mechanisms to move the associated cleaning member to and away from said cleaning position.

8. A printing machine comprising:

a plurality of printheads, each printhead in the plurality of printheads having a front face through which ink is ejected to apply ink to a substrate;

a plurality of cleaning members supported on a plurality of beams within a frame, each cleaning member having a length that spans a width of the front face of one printhead in the plurality of printheads and each cleaning member being positioned opposite one printhead in the plurality of printheads in a one-to-one correspondence;

a sweep mechanism operatively connected to the beams to move the beams in a vertical direction with reference to the plurality of printheads to move each cleaning member contacting and spanning the front face of the one printhead in said plurality of printheads opposite the cleaning member between an upper end of the front face of the printhead and a lower end of the front face of the printhead face when the cleaning member is in a cleaning position to wipe the front face of the one printhead;

a plurality of drive mechanisms, each drive mechanism being associated with one cleaning member in the plurality of cleaning members in a one-to-one correspondence, each drive mechanism being configured to selectively move the cleaning member associated with the drive mechanism between said cleaning position, in which the cleaning member contacts and spans the front face of the printhead opposite the cleaning member, and a retracted position, in which the cleaning member is separated from the front face of the printhead opposite the cleaning member; and a mechanism operatively connected to the frame to translate said frame relative to the plurality of printheads to retract the plurality of cleaning members from a position where the cleaning members are in one-to-one correspondence with the plurality of printheads to enable at least one backing member to return to a position opposite the plurality of printheads.

9. The printing machine according to claim 8, wherein:

said plurality of printheads are provided in at least two rows of printheads, each of said rows in said at least two rows of printheads including at least one printhead and each row of printheads is attached to a beam; and the plurality of cleaning members being provided in at least two rows that are positioned opposite the rows in the plurality of printheads in a one-to-one correspondence.

10. The printing machine according to claim 8 wherein:

each cleaning member includes a wiper blade configured to pivot to and from said cleaning position; and each drive mechanism in the plurality of drive mechanisms being operatively connected to said wiper blade of the cleaning member associated with the drive mechanism to pivot said wiper blade.

11. The printing machine according to claim 10, wherein each drive mechanism includes a solenoid.

12. The printing machine according to claim 10, wherein:

each cleaning member includes a pivot arm and one end of each pivot arm is connected to the wiper blade of the cleaning member;

each drive mechanism in the plurality of drive mechanisms is connected to said pivot arm of the cleaning member associated with the drive mechanism to pivot said pivot arm and move said wiper blade between said cleaning position and said retracted position.

13. The printing machine according to claim 8, wherein each of said cleaning members includes a single wiper blade.

14. The printing machine according to claim 13, wherein each wiper blade is formed of a rigid but flexible material.

15. The printing machine according to claim 8 further comprising:

a control component operable to selectively activate each drive mechanism in the plurality of drive mechanisms to move each cleaning member in the plurality of cleaning members selectively between said cleaning position and said retracted position.

16. A method for cleaning a plurality of printheads in a printing machine, comprising:

moving a frame supporting a plurality of cleaning members from a position where the plurality of cleaning members enable at least one backing member to be positioned in front of the plurality of printheads to a position where the plurality of cleaning members are in front of the plurality of printheads in one-to-one correspondence, each of said cleaning members having a length that enables the cleaning member to span a width of the printhead opposite the cleaning member and each cleaning member being configured to clean the entire face of the only one printhead in said plurality of printheads opposite the cleaning member in response to the cleaning member being in the cleaning position and the cleaning member being moved between an upper end of the face of the printhead and a lower end of the face of the printhead to wipe the face of the printhead spanned by the cleaning member; and selectively moving one or more of said cleaning members in the plurality of cleaning members to said cleaning position to enable the moved cleaning member to contact and span the face of the printhead opposite the cleaning member after movement of the frame has positioned the plurality of cleaning members in front of the plurality of printheads.

17. The method for cleaning a plurality of printheads according to claim 16, further comprising:

determining which one or ones of the printheads in the plurality of printheads requires cleaning; and selectively moving each cleaning member associated with the one or ones of the plurality of printheads determined to require cleaning to the cleaning position.

* * * * *